US010724520B2

(12) United States Patent
Rusich et al.

(10) Patent No.: US 10,724,520 B2
(45) Date of Patent: Jul. 28, 2020

(54) REMOVABLE HYDROPAD FOR AN ORBITING SCROLL

(71) Applicant: Hamilton Sundstrand Corporation, Windsor Locks, CT (US)

(72) Inventors: Richard Rusich, Ellington, CT (US); Lino S. Italia, Rocky Hill, CT (US); Seth E. Rosen, Middletown, CT (US); Darryl A. Colson, West Suffield, CT (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 424 days.

(21) Appl. No.: 15/430,758

(22) Filed: Feb. 13, 2017

(65) Prior Publication Data

US 2018/0230998 A1 Aug. 16, 2018

(51) Int. Cl.

| | |
|---|---|
| ***F01C 17/06*** | (2006.01) |
| ***F01C 1/06*** | (2006.01) |
| ***F01C 1/02*** | (2006.01) |
| ***F04C 18/02*** | (2006.01) |
| ***F04C 29/00*** | (2006.01) |
| ***F01C 21/02*** | (2006.01) |
| ***F04C 27/00*** | (2006.01) |

(52) U.S. Cl.

CPC ..... *F04C 18/0253* (2013.01); *F01C 21/02* (2013.01); *F04C 18/0215* (2013.01); *F04C 18/0269* (2013.01); *F04C 27/001* (2013.01); *F04C 27/005* (2013.01); *F04C 29/0085* (2013.01); *F04C 27/008* (2013.01); *F04C 2230/60* (2013.01); *F04C 2240/30* (2013.01); *F04C 2240/54* (2013.01)

(58) Field of Classification Search

CPC ..... F01C 1/0246; F01C 1/0253; F01C 21/02; F01C 17/063; F01C 1/06; F04C 18/0246; F04C 29/0085; F04C 18/0253; F04C 18/0215

See application file for complete search history.

(56) References Cited

U.S. PATENT DOCUMENTS 4,065,279 A 12/1977 McCullough
4,475,875 A * 10/1984 Sugimoto ..... F01C 1/0215 418/151
4,993,928 A 2/1991 Fraser, Jr.
(Continued)

FOREIGN PATENT DOCUMENTS

JP 2008051018 A 3/2008
JP 2008088847 A 4/2008
(Continued)

OTHER PUBLICATIONS

Search Report dated Jun. 26, 2018, EP Application No. 18156436, 45 pages.

*Primary Examiner* — Deming Wan
(74) *Attorney, Agent, or Firm* — Cantor Colburn LLP

(57) ABSTRACT

A scroll compressor is provided and includes a motor housing having a support surface, a fixed scroll fixedly disposable on the motor housing, an orbiting scroll which is operably disposable for fluid-compressive orbital movement relative to the fixed scroll and a removable hydropad removably disposable on the support surface between the orbiting scroll and the support surface.

16 Claims, 5 Drawing Sheets

(56) References Cited

U.S. PATENT DOCUMENTS

| | | | | |
|---|---|---|---|---|
| 6,123,530 | A * | 9/2000 | Nakazawa | F01C 17/063 418/55.1 |
| 6,247,910 | B1 * | 6/2001 | Yokoyama | F01C 21/102 29/464 |
| 6,299,424 | B1 | 10/2001 | Futagami et al. | |
| 9,217,592 | B2 * | 12/2015 | Turney | F25B 45/00 |
| 2005/0281697 | A1 | 12/2005 | Lifson et al. | |
| 2006/0130495 | A1 * | 6/2006 | Dieckmann | F01C 1/0246 62/87 |
| 2007/0031275 | A1 * | 2/2007 | Nogawa | F04C 29/0021 418/55.2 |
| 2009/0178790 | A1 * | 7/2009 | Schreiber | F25B 39/028 165/158 |
| 2011/0081264 | A1 * | 4/2011 | Ishizono | F04C 18/0207 417/410.5 |
| 2013/0121866 | A1 * | 5/2013 | Jang | F04C 18/00 418/55.5 |

FOREIGN PATENT DOCUMENTS

| | | | |
|---|---|---|---|
| JP | 2010037945 | A | 2/2010 |
| JP | 2015124739 | A | 7/2015 |
| KR | 20140136796 | A | 12/2014 |

* cited by examiner

REMOVABLE HYDROPAD FOR AN ORBITING SCROLL

BACKGROUND OF THE DISCLOSURE

The subject matter disclosed herein relates to compressors and, more particularly, to scroll compressors with removable hydropads.

Scroll compressors are one type of a compressor that is commonly used in vapor cycle refrigeration systems (VCS) and typically use a scroll set to pump refrigerant. The scroll set can include a fixed scroll and an orbiting scroll. During compressor operation pressure in the orbiting scroll pockets tends to push the orbiting scroll against a hydropad surface. However, since the hydropad often contains seals that constrain refrigerant gas, the orbiting scroll is able to "ride" on a cushion of high pressure refrigerant gas in the hydropad cavity. That is, the high pressure refrigerant gas supports the orbiting scroll and prevents the orbiting scroll from actually coming in contact with the hydropad surface.

During compressor start-up and shutdown operations, the volume of the high pressure refrigerant gas drops and the orbiting scroll tends to touch down on the hydropad surface as a result. Over years of compressor in-service operations, some units that are returned for overhaul and repair have been found to exhibit excessive wear of the hydropad surface and/or excessive wear of the hydropad seal glands. Thus, since the hydropad is typically an integral part of a motor housing which are usually one-piece designs, the damage to the hydropad surface or seal glands cannot be repaired and necessitates time consuming and costly replacement of the entire motor housing.

BRIEF DESCRIPTION OF THE DISCLOSURE

According to one aspect of the disclosure, a scroll compressor is provided and includes a motor housing having a support surface, a fixed scroll fixedly disposable on the motor housing, an orbiting scroll which is operably disposable for fluid-compressive orbital movement relative to the fixed scroll and a removable hydropad that is removably disposable on the support surface between the orbiting scroll and the support surface.

In accordance with additional or alternative embodiments, the fixed and orbiting scrolls have complementary volute, involute, spiral or hybrid curve vane geometries.

In accordance with additional or alternative embodiments, the orbiting scroll includes a base, an orbiting scroll vane that extends from the base in a first direction, a shaft that extends from the base in a second direction opposite the first direction and hydropad seals that protrude from the base in the second direction.

In accordance with additional or alternative embodiments, a drive ring is disposable about the support surface and the removable hydropad.

In accordance with additional or alternative embodiments, the removable hydropad is one or more of pressable into, screwable into or pinnable to the motor housing.

In accordance with additional or alternative embodiments, a material of the removable hydropad differs from a material of the motor housing.

In accordance with additional or alternative embodiments, the material of the removable hydropad is heavier than the material of the motor housing.

In accordance with additional or alternative embodiments, the material of the removable hydropad includes cast iron or aluminum alloy and the material of the motor housing includes aluminum alloy.

In accordance with additional or alternative embodiments, the removable hydropad has an integral bearing housing which is removable from the motor housing.

According to another aspect of the disclosure, a scroll compressor is provided and includes a motor housing having a support surface and a longitudinal axis, a fixed scroll which is operably disposable on and fixable relative to the motor housing, an orbiting scroll which is operably disposable for fluid-compressive orbital movement relative to the fixed scroll about the longitudinal axis and a removable hydropad which is non-integrally and removably disposable on the support surface to block the orbiting scroll from contact with the support surface.

In accordance with additional or alternative embodiments, the fixed and orbiting scrolls have complementary volute, involute, spiral or hybrid curve vane geometries.

In accordance with additional or alternative embodiments, the orbiting scroll includes a base, an orbiting scroll vane that extends from the base in a first direction, a shaft that extends from the base in a second direction opposite the first direction and hydropad seals that protrude from the base in the second direction.

In accordance with additional or alternative embodiments, a drive ring is disposable about the support surface and the removable hydropad.

In accordance with additional or alternative embodiments, the removable hydropad is one or more of pressable into, screwable into or pinnable to the motor housing.

In accordance with additional or alternative embodiments, a material of the removable hydropad differs from a material of the motor housing.

In accordance with additional or alternative embodiments, the material of the removable hydropad is heavier than the material of the motor housing.

In accordance with additional or alternative embodiments, the material of the removable hydropad includes cast iron or aluminum alloy and the material of the motor housing includes aluminum alloy.

In accordance with additional or alternative embodiments, the removable hydropad has an integral bearing housing which is removable from the motor housing.

In accordance with additional or alternative embodiments, a vapor compression refrigeration system (VCRS) is provided and includes the scroll compressor and the removable hydropad.

According to yet another aspect of the disclosure, a method of assembling a scroll compressor is provided and includes forming a motor housing, which is connectable with a fixed scroll and which has a support surface and a longitudinal axis, removably disposing a removable hydropad on the support surface, operably disposing an orbiting scroll for fluid-compressive orbital movement relative to the fixed scroll about the longitudinal axis such that the removable hydropad is interposed between the orbiting scroll and the support surface and operably disposing the fixed scroll on the motor housing to be fixed relative to the motor housing.

In accordance with additional or alternative embodiments, the method further includes one or more of pressing the removable hydropad into the motor housing, screwing the removable hydropad into the motor housing or pinning the removable hydropad onto the motor housing.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

As will be described below, a scroll compressor with a removable hydropad is provided with a two-piece motor housing and hydropad design. During initial assembly, a removable hydropad is inserted onto a support surface of a motor housing along with the remaining components of the compressor. Over time, if damage to the hydropad or its surfaces occurs as a result of in-service scroll compressor operation, the scroll compressor can be disassembled and the removable hydropad removed from the motor housing. A new hydropad can then be inserted into the motor housing and the scroll compressor can be reassembled. Thus, a damaged hydropad surface can be repaired or mitigated by simply removing and replacing the hydropad itself. This eliminates the need to replace the entire motor housing, which ultimately reduces both labor and material cost of overhaul and repair.

Figure 1:
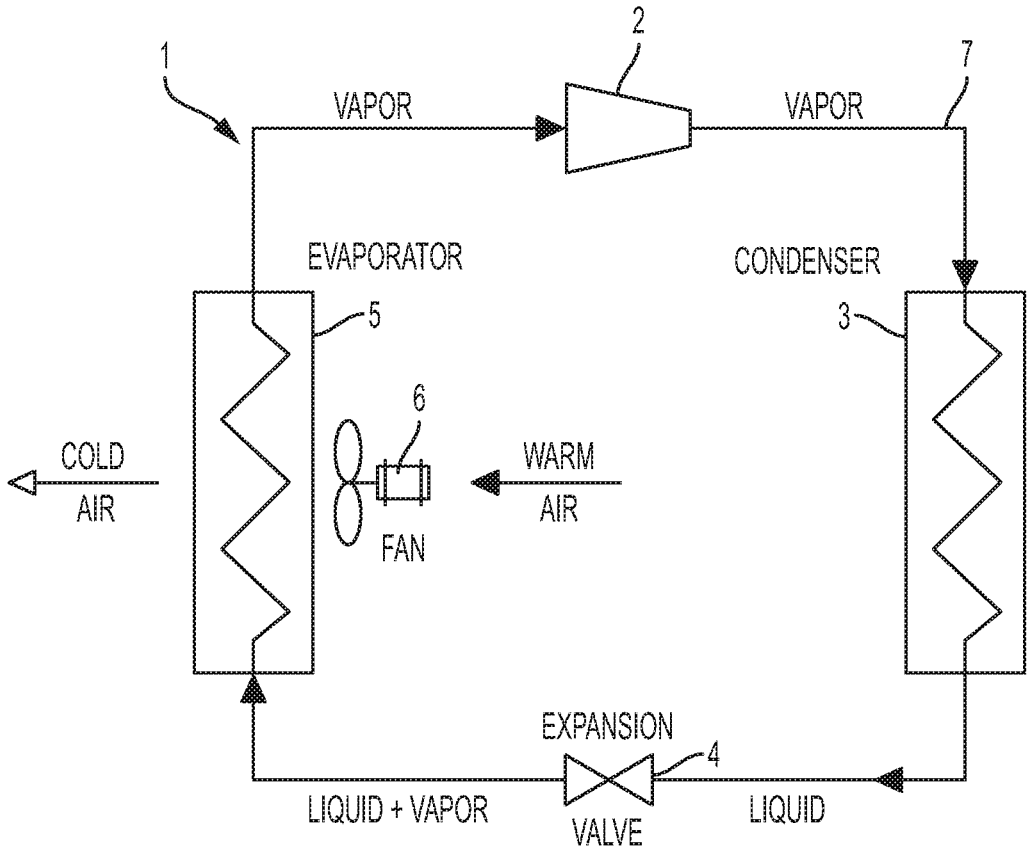
FIG. 1 is a schematic illustration of a vapor cycle refrigeration system in accordance with embodiments.

With reference to FIG. 1, a vapor cycle refrigeration system (VCRS) 1 is provided for execution of a vapor-compression cycle. The VCRS 1 includes a compressor 2, a condenser 3, an expansion valve 4, an evaporator 5, a fan 6 and piping 7 by which the various components of the VCRS 1 are fluidly communicative with each other. During operations, the VCRS 1 uses a circulating liquid refrigerant as a medium, which absorbs and removes heat from space, to be cooled and to subsequently reject that heat. That is, circulating refrigerant enters the compressor 2 as a saturated vapor and is compressed therein to a higher pressure and a higher temperature. The hot, compressed vapor is then provided as a superheated vapor that is at a temperature and pressure at which it can be condensed in the condenser 3 with a flow of either cooling water or cooling air. This is where the circulating refrigerant rejects heat from the system and the rejected heat is carried away by either the water or the air (whichever may be the case).

The condensed liquid refrigerant is next routed as a saturated liquid through the expansion valve 4 where it undergoes an abrupt reduction in pressure which results in the adiabatic flash evaporation of a part of the liquid refrigerant. The auto-refrigeration effect of the adiabatic flash evaporation lowers the temperature of this liquid and vapor refrigerant mixture to where it is colder than the temperature of the enclosed space to be refrigerated. Next, the cold mixture is routed through coils or tubes in the evaporator 5 with the fan 6 circulating warm air across the coils or tubes to cause the liquid part of the cold refrigerant mixture to evaporate. At the same time, the circulating air is cooled and lowers the temperature of the surrounding space.

To complete the refrigeration cycle, the refrigerant vapor from the evaporator 5 is returned to its original saturated vapor condition and is routed back into the compressor 2.

Figure 2A:
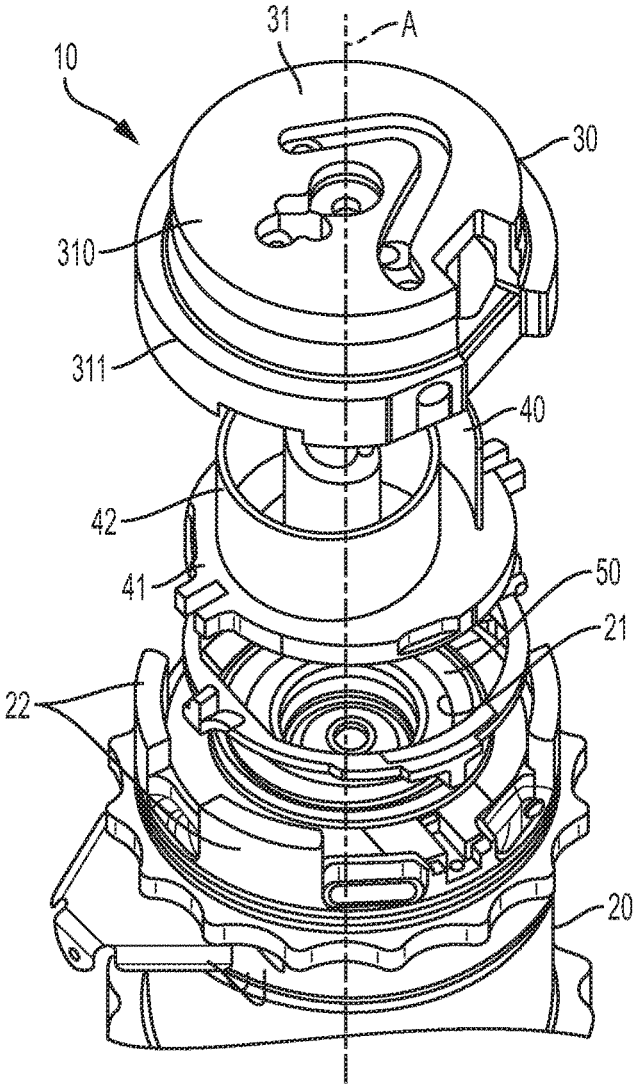
FIG. 2A is a perspective view of a scroll compressor in accordance with embodiments.
Figure 2B:
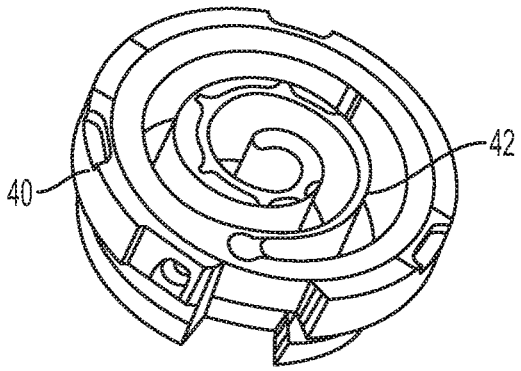
FIG. 2B is a perspective view of an underside of a fixed scroll of the scroll compressor of FIG. 2A.
Figure 3:
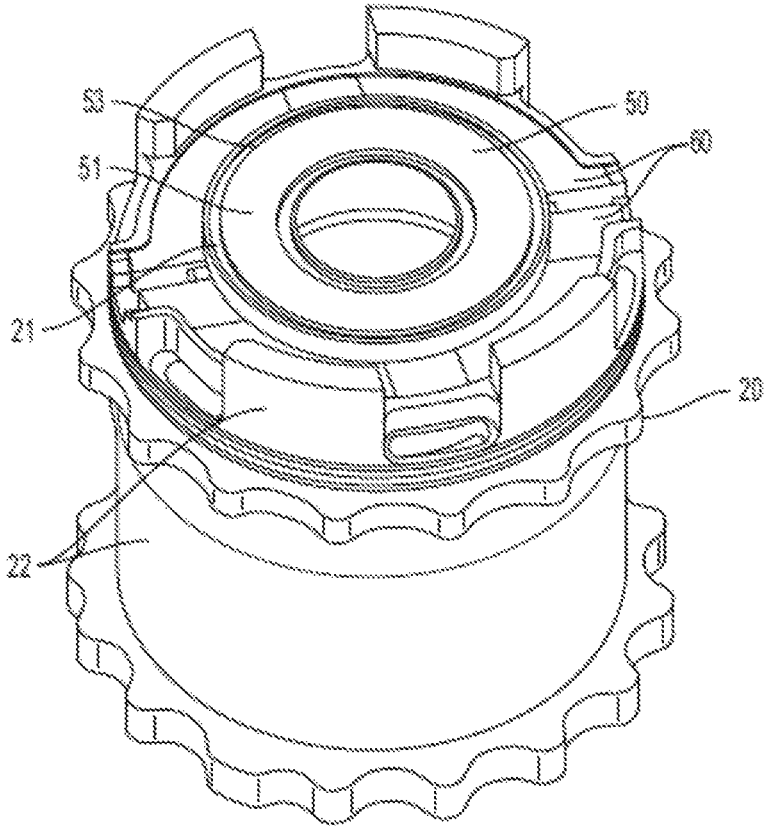
FIG. 3 is a perspective view of a motor housing and a removable hydropad of the scroll compressor of FIGS. 2A and 2B.
Figure 4:
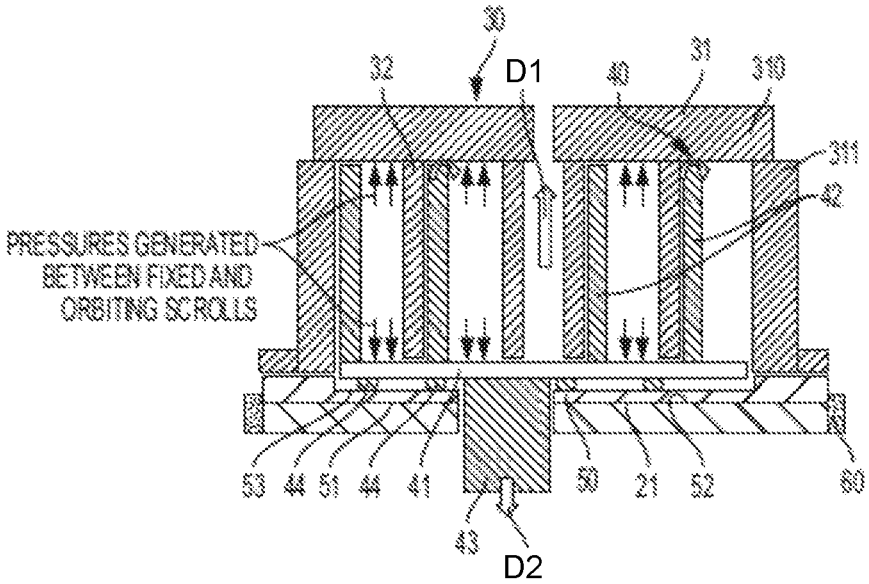
FIG. 4 is a side view of the motor housing and the removable hydropad of FIG. 3 along with fixed and orbiting scrolls.
Figure 5:
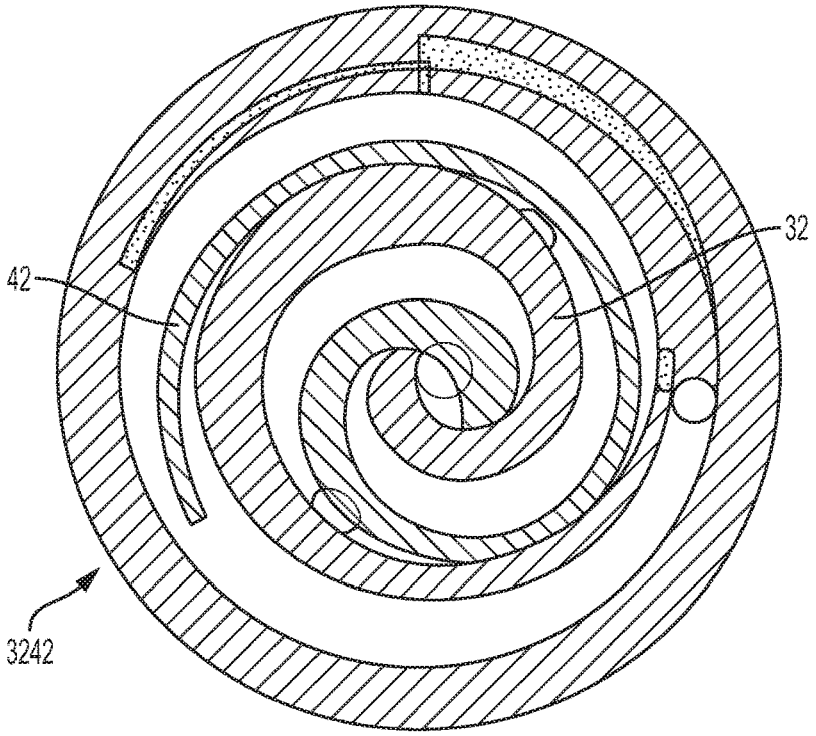
FIG. 5 is a top-down view of the fixed and orbiting scrolls of FIG. 2.

With reference to FIGS. 2A and 2B and with additional reference to FIGS. 3-5, a scroll compressor 10 is provided for use as the compressor 2 in the VCRS 1 of FIG. 1, for example. The scroll compressor 10 includes a motor housing 20, a fixed scroll 30, an orbiting scroll 40 and a removable hydropad 50. The motor housing 20 is generally cylindrical in shape and has a support surface 21 with an annular shape, sidewalls 22 disposed annularly about the support surface 21 and a longitudinal axis A. The motor housing 20 may further include a drive ring 60 (see FIGS. 3 and 4) that is disposable in one or more parts about the support surface 21 and the removable hydropad 50.

The fixed scroll 30 is operably disposable on and fixable relative to the motor housing 20 and includes a cap portion 31 and a fixed scroll vane 32 (see FIG. 4) disposed within the cap portion 31. The cap portion 31 is formed of an annular end cap portion 310 that serves as an end cap of the scroll compressor 10 and end cap sidewalls 311 that are disposed annularly about the annular end cap portion 310 and are engagable with the sidewalls 22. The fixed scroll vane 32 extends from the annular end cap portion 310 toward the support surface 21 along the longitudinal axis A.

The orbiting scroll 40 is operably disposable for fluid-compressive orbital movement relative to the fixed scroll 30 about the longitudinal axis. The orbiting scroll 40 includes an annular base 41, which is generally disposable within the scroll compressor 10 to be parallel with the annular end cap portion 310, an orbiting scroll vane 42 that extends toward the annular end cap portion 310 from the annular base 41 in a first direction D1 defined along the longitudinal axis A, an orbiting scroll shaft 43 (see FIG. 4) that drives orbital movement of the orbiting scroll vane 42 and extends from the annular base 41 in a second direction D2, which is opposite the first direction D1, and hydropad seals 44 (see FIG. 4). The hydropad seals 44 may be provided as plural hydropad seals 44 and extend circumferentially about the orbiting scroll shaft 43. The hydropad seals 44 protrude from the annular base 41 in the second direction D2.

As shown in FIG. 5, the fixed scroll vane 32 and the orbiting scroll vane 43 may have various complementary shapes, patterns or vane geometries 3242 These include, but are not limited to, volute or involute shapes, patterns or vane geometries, spiral shapes, patterns or vane geometries and/or hybrid curve shapes, patterns or vane geometries. In any case, during operations of the scroll compressor 10, the orbiting scroll vane 43 orbits about the longitudinal axis A and thus compresses air or fluid between the orbiting scroll vane 43 and the fixed scroll vane 32.

Such compression has the additional effect, which is illustrated in FIG. 4, of pressurizing the orbiting scroll 40 (i.e., the lower surface of the annular base 41 and the hydropad seals 44) toward the support surface 21. The removable hydropad 50 is thus provided to be non-integrally and removably disposable on the support surface 21 to block the lower surface of the annular base 41 and the hydropad seals 44 of the orbiting scroll 40 from coming into contact with the support surface 21. Therefore, when and if damage occurs as a result of the orbiting scroll 40 contacting any surface, such damage will be done to the removable hydropad 50 and not to the support surface 21. As such, since the removable hydropad 50 can be removed from the motor housing 20 and replaced by another removable hydropad 50, damage to the motor housing 20 as a whole can be avoided and any repairs (which now require mere replacement of the removable hydropad 50) can be completed in greatly reduced time and with little expense and without the need for disassembly and re-assembly of the motor housing 20.

In accordance with embodiments, the removable hydropad 50 includes an annular body 51 that extends about the orbiting scroll shaft 43 with a lower surface 52 and an upper surface 53. The lower surface 52 is disposable to non-integrally and removably sit on the support surface 21 of the motor housing 20. The upper surface is disposable to make contact with the lower surface of the annular base 41 and the hydropad seals 44 of the orbiting scroll 40. The removable hydropad is one or more of pressable into, screwable into or pinnable to the motor housing 20 and is formed of or includes a material that differs from a material of the motor housing 20. That is, the material of the removable hydropad 50 may be heavier and more wear resistant and durable than the material of the motor housing 20. For example, the material of the removable hydropad 50 may include cast iron or an aluminum alloy and the material of the motor housing 20 may include a relatively light aluminum alloy.

Figure 6:
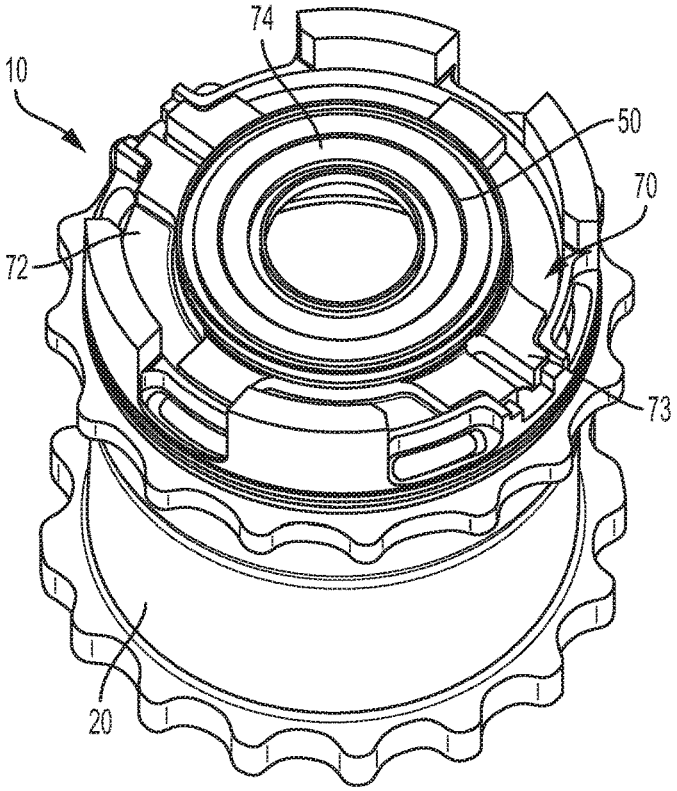
FIG. 6 is a perspective view of a motor housing and a removable hydropad/bearing housing combination of a scroll compressor in accordance with alternative embodiments.
Figure 7:
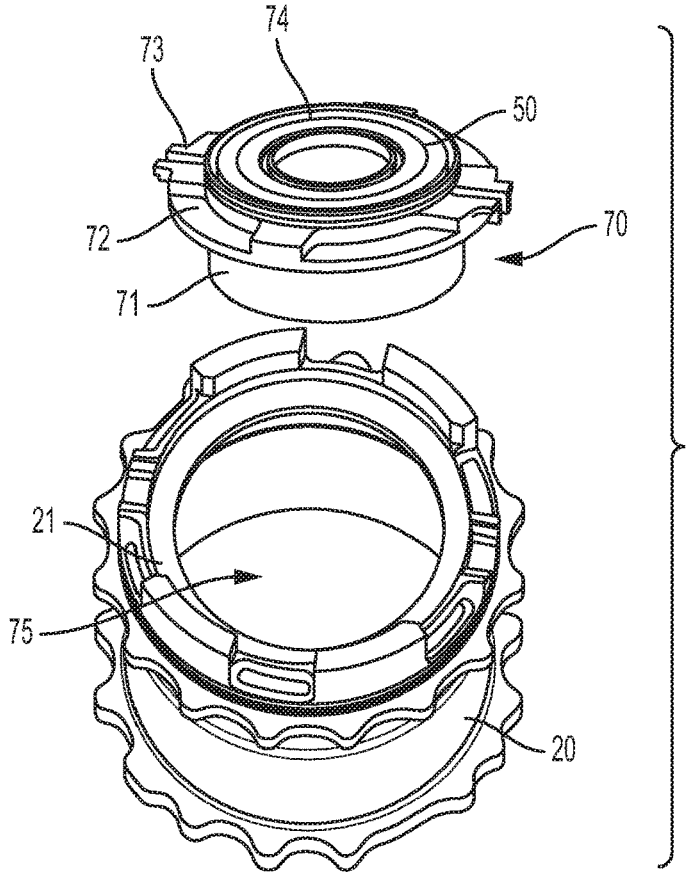
FIG. 7 is an exploded, perspective view of the motor housing and the removable hydropad/bearing housing combination of FIG. 6.

In accordance with further embodiments and with reference to FIGS. 6 and 7, the removable hydropad 50 may be provided or paired with an integral bearing housing 70 that is removable from the motor housing 20. The integral bearing housing 70 includes a central, annular cylindrical element 71, an annular flange 72 that extends radially outwardly from the central, annular cylindrical element 71, drive ring elements 73 that are defined above the annular flange 72 and a hydropad surface element 74 that forms an uppermost surface. In such cases, the support surface 21 is formed to define an aperture 75 whereby the annular flange 72 sits on an upper surface of the support surface 21 with the central, annular cylindrical element 71 disposed within the aperture 75. The hydropad surface element 74 is thus disposable to make contact with the removable hydropad 50 (as shown in FIG. 4) during operations of the scroll compressor 10.

Figure 8:
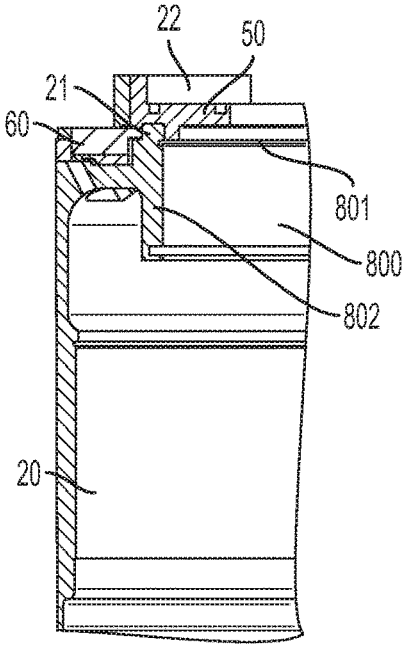
FIG. 8 is a side view of the motor housing and the removable hydropad of FIG. 3.
Figure 9:
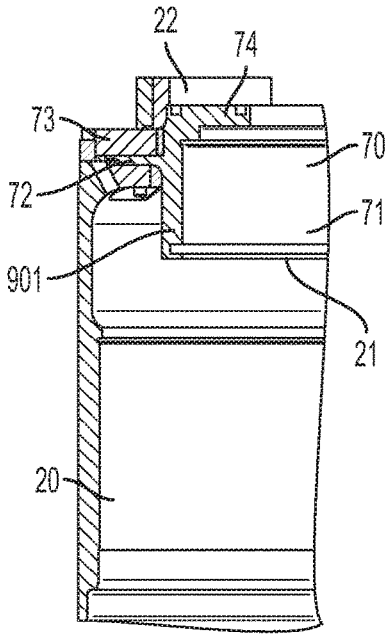
FIG. 9 is a side view of the motor housing and the removable hydropad/bearing housing combination of FIGS. 6 and 7.

With reference to FIGS. 8 and 9, the differences between the embodiments of FIG. 3 and those of FIGS. 6 and 7 can be seen in the cross-sectional view of the removable hydropad 50 (see FIG. 8) and in the cross-sectional view of the removable hydropad 50 which is provided with an integral bearing housing 70 (see FIG. 9). As shown in FIGS. 8 and 9, the primary difference between the two cases is that the removable hydropad 50 of FIG. 8 is non-integrally and removably disposed on the upper surface 801 of the bearing housing 800 and is separate and distinct from the drive ring 60. By contrast, FIG. 9 indicates that the hydropad surface element 74 provided with the integral bearing housing 70 is a single component that includes the drive ring elements 73. In addition, while the motor housing 20 in FIG. 8 includes an intervening rim element 802 that is disposed about the bearing housing 800 and is interposed between the removable hydropad 50 and the drive ring 60, the corresponding region in FIG. 9 is taken up by a perimetric, exterior component 901.

In accordance with another aspect of the invention, a method of assembling the scroll compressor 10 is provided. The method includes forming the motor housing 20 to be connectable with the fixed scroll 30 and which has a support surface 21 and a longitudinal axis A, removably disposing the removable hydropad 50 on the support surface 21 and operably disposing the orbiting scroll 40 for fluid-compressive orbital movement relative to the fixed scroll 30 about the longitudinal axis A. The operable disposition of the orbiting scroll 40 is executed or conducted such that the removable hydropad 50 is interposed between the orbiting scroll 40 and the support surface 21. The method further includes operably disposing the fixed scroll 30 on the motor housing 20 to be rotationally and orbitally fixed relative to the motor housing 20. In accordance with embodiments, the removable disposition of the removable hydropad 50 may include one or more of pressing the removable hydropad 50 into the motor housing 20, screwing the removable hydropad 50 into the motor housing 20 or pinning the removable hydropad 50 onto the motor housing 20.

After a period of time during which the scroll compressor 10 is operated, the fixed scroll 30 and the orbiting scroll 40 may be removed from the motor housing 20. At this point, the surfaces of the removable hydropad 50 may be inspected for wear or damage. If the results of this inspection reveal that the surfaces of the removable hydropad 50 are overly worn or damaged, the removable hydropad 50 can be replaced by another removable hydropad 50. The scroll compressor 10 can then be re-assembled with the new removable hydropad 50 without having has to conduct a wholesale repair or replacement of the motor housing 20.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A scroll compressor, comprising:

a motor housing having a support surface;

a fixed scroll fixedly disposable on the motor housing;

an orbiting scroll which is operably disposable for fluid-compressive orbital movement relative to the fixed scroll whereby the fluid-compressive orbital movement of the orbiting scroll pressurizes the orbiting scroll toward the support surface, the orbiting scroll comprising a base, an orbiting scroll vane that extends from the base in a first direction, a shaft that extends from the base in a second direction opposite the first direction and hydropad seals that protrude from the base in the second direction and extend circumferentially about the shaft;

a removable hydropad removably disposable on the support surface between the orbiting scroll and the support surface to block the hydropad seals of the orbiting scroll from coming into contact with the support surface; and a replacement removable hydropad removably disposable on the support surface between the orbiting scroll and the support surface with the removable hydropad having been removed and replaced by the replacement removable hydropad to block the hydropad seals of the orbiting scroll from coming into contact with the support surface.

2. The scroll compressor according to claim 1, wherein the fixed and orbiting scrolls have complementary volute, involute, spiral or hybrid curve vane geometries.

3. The scroll compressor according to claim 1, wherein the base defines a plane and the hydropad seals protrude from the plane of the base in the second direction and extend circumferentially about the shaft to be interposed between the plane of the base and the removable hydropad or the replacement removable hydropad.

4. The scroll compressor according to claim 1, wherein each of the removable hydropad and the replacement removable hydropad is one or more of pressable into, screwable into or pinnable to the motor housing.

5. The scroll compressor according to claim 1, wherein respective materials of the removable hydropad and the replacement removable hydropad each differ from a material of the motor housing.

6. The scroll compressor according to claim 5, wherein the respective materials of the removable hydropad and the replacement removable hydropad are each heavier than the material of the motor housing.

7. The scroll compressor according to claim 5, wherein the respective materials of the removable hydropad and the replacement removable hydropad each comprise cast iron and the material of the motor housing comprises aluminum alloy.

8. The scroll compressor according to claim 1, wherein each of the removable hydropad and the replacement removable hydropad has an integral bearing housing which is removable from the motor housing.

9. A scroll compressor, comprising:

a motor housing having a support surface and a longitudinal axis;

a fixed scroll which is operably disposable on and fixable relative to the motor housing;

an orbiting scroll which is operably disposable for fluid-compressive orbital movement relative to the fixed scroll about the longitudinal axis whereby the fluid-compressive orbital movement of the orbiting scroll pressurizes the orbiting scroll toward the support surface, the orbiting scroll comprising a base, an orbiting scroll vane that extends from the base in a first direction, a shaft that extends from the base in a second direction opposite the first direction and hydropad seals that protrude from the base in the second direction and extend circumferentially about the shaft;

a removable hydropad which is non-integrally and removably disposable on the support surface to block the orbiting scroll from contact with the support surface to block the hydropad seals of the orbiting scroll from coming into contact with the support surface; and a replacement removable hydropad which is non-integrally and removably disposable on the support surface with the removable hydropad having been removed and replaced by the replacement removable hydropad to block the hydropad seals of the orbiting scroll from coming into contact with the support surface.

10. The scroll compressor according to claim 9, wherein the fixed and orbiting scrolls have complementary volute, involute, spiral or hybrid curve vane geometries.

11. The scroll compressor according to claim 9, wherein the base defines a plane and the hydropad seals protrude from the plane of the base in the second direction and extend circumferentially about the shaft to be interposed between the plane of the base and the removable hydropad or the replacement removable hydropad.

12. The scroll compressor according to claim 9, wherein each of the removable hydropad and the replacement removable hydropad is one or more of pressable into, screwable into or pinnable to the motor housing.

13. The scroll compressor according to claim 9, wherein respective materials of the removable hydropad and the replacement removable hydropad are each heavier than the material of the motor housing.

14. The scroll compressor according to claim 13, wherein the respective materials of the removable hydropad and the replacement removable hydropad each comprise cast iron and the material of the motor housing comprises aluminum alloy.

15. The scroll compressor according to claim 9, wherein each of the removable hydropad and the replacement removable hydropad has an integral bearing housing which is removable from the motor housing.

16. A vapor compression refrigeration system (VCRS) comprising the scroll compressor, the removable hydropad according to claim 10 and the replacement removable hydropad according to claim 9.

* * * * *